US009545134B1

(12) United States Patent
Tan

(10) Patent No.: US 9,545,134 B1
(45) Date of Patent: Jan. 17, 2017

(54) WATERPROOF ZIPPER

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 0 days.

(21) Appl. No.: 14/883,050

(22) Filed: Oct. 14, 2015

(51) Int. Cl.

| | |
|---|---|
| ***A44B 19/24*** | (2006.01) |
| ***A44B 19/32*** | (2006.01) |
| ***A45C 13/10*** | (2006.01) |
| ***A44B 19/26*** | (2006.01) |

(52) U.S. Cl.
CPC ..... *A44B 19/32* (2013.01); *A44B 19/24* (2013.01); *A44B 19/262* (2013.01); *A45C 13/103* (2013.01)

(58) Field of Classification Search
CPC ..... Y10T 24/2514; Y10T 24/2505; Y10T 24/2502; Y10T 24/2511; Y10T 24/2563; Y10T 24/2566; Y10T 24/257; A44B 19/24; A44B 19/262; A44B 19/32; A44B 19/30; A45C 13/103
USPC ..... 24/384
See application file for complete search history.

(56) References Cited

U.S. PATENT DOCUMENTS

| | | | | | |
|---|---|---|---|---|---|
| 1,977,528 | A * | 10/1934 | Puc | A44B 19/30 | 24/416 |
| 2,229,216 | A * | 1/1941 | Marinsky | A44B 19/26 | 24/382 |
| 2,321,926 | A * | 6/1943 | Marinsky | A44B 19/301 | 24/384 |
| 2,641,037 | A * | 6/1953 | Gossner | A44B 19/32 | 24/384 |
| 3,162,917 | A * | 12/1964 | Bair | A44B 19/32 | 24/389 |
| 3,490,109 | A * | 1/1970 | Heimberger | A44B 19/32 | 24/389 |
| 3,668,745 | A * | 6/1972 | Krupp | A44B 19/32 | 24/389 |
| 4,875,258 | A * | 10/1989 | Goedecke | A44B 19/32 | 24/384 |
| 4,941,238 | A * | 7/1990 | Clark | A44B 19/14 | 24/389 |
| 6,092,266 | A * | 7/2000 | Lee | A44B 19/32 | 24/384 |
| 8,499,422 | B2 * | 8/2013 | Jacobsen | A44B 19/32 | 24/382 |
| 9,125,459 | B1 * | 9/2015 | Lin | A44B 19/26 | |
| 2008/0229553 | A1 * | 9/2008 | Bonaglia | A44B 19/32 | 24/389 |
| 2010/0170067 | A1 * | 7/2010 | Takazawa | A44B 19/308 | 24/419 |
| 2013/0318751 | A1 * | 12/2013 | Lin | A44B 19/42 | 24/429 |
| 2014/0304954 | A1 * | 10/2014 | La Rocca | A44B 19/08 | 24/389 |
| 2014/0310923 | A1 * | 10/2014 | Matsushima | A44B 19/305 | 24/429 |

(Continued)

*Primary Examiner* — Robert J Sandy
*Assistant Examiner* — Jason W San

(57) ABSTRACT

A waterproof zipper consisting of a first zipper tape, a second zipper tape, and a zipper slider consisting of slide, a pressure plate and a pull tab is disclosed. The first zipper tape and the second zipper tape are specially configured to enhance the tensile strength and waterproof characteristics of the zipper. The pressure plate defines with the topmost edges of the two second stop walls of the slider a constraint space for holding down the first zipper tape and the second zipper tape to prevent accidental displacement of the zipper slider relative to the first and second zipper tapes.

3 Claims, 8 Drawing Sheets

(56) References Cited

U.S. PATENT DOCUMENTS

| | | | | |
|---|---|---|---|---|
| 2014/0359978 | A1* | 12/2014 | Wang | A44B 19/42<br>24/389 |
| 2016/0198812 | A1* | 7/2016 | Tan | A44B 19/32<br>24/389 |

* cited by examiner

WATERPROOF ZIPPER

BACKGROUND OF THE INVENTION

1. Field of the Invention

The present invention relates to zip fasteners and more particularly, to a waterproof zipper, which has good tensile strength and waterproof characteristics. Embodiments provide a constraint space between a bottom edge of a pressure plate and the topmost edges of two second stop walls of a slider of a zipper slider thereof for enabling the zipper slider to be positively locked to the zipper tapes.

2. Description of the Related Art

A conventional zipper generally comprises two zipper tapes, each having an interlocking series of teeth, and a zipper slider slidable to force the two series of teeth into engagement with each other or to cause separation of the two series of teeth. However, if the zipper is accidentally vibrated, the zipper slider can be forced to displace, causing separation of the two series of teeth. Therefore, when a zipper is used in an article that needs to protect against wind and water (such as a raincoat), a shielding strip and a fastener must be provided at an outer side of the zipper so that the shielding strip can be locked to shield the zipper.

SUMMARY OF THE INVENTION

The present invention has been accomplished under the circumstances in view. An object of embodiments of the present invention is to provide a waterproof zipper, which has good tensile strength and waterproof characteristics, and which provides a constraint space between a bottom edge of a pressure plate and the topmost edges of two second stop walls of a slider of a zipper slider thereof for enabling the zipper slider to be positively locked to the zipper tapes.

To achieve this and other objectives of the invention, an embodiment waterproof zipper comprises a first zipper tape, a second zipper tape, and a zipper slider including a slider, a pressure plate and a pull tab. The first zipper tape provides a first rim strip portion, a second rim strip portion suspended above the first rim strip portion, a first series of teeth located at the first rim strip portion, and a lateral coupling strip portion located at the second rim strip portion. The second zipper tape provides a third rim strip portion, a fourth rim strip portion suspended above the third rim strip portion, a second series of teeth located at the third rim strip portion, and a lateral retaining strip portion located at the fourth rim strip portion. The slider is coupled to the first zipper tape and the second zipper tape. When moving the slider, the first series of teeth and the second series of teeth are forced into engagement with each other or separated from each other, and at the same time, the lateral coupling strip portion and the lateral retaining strip portion are abuted against each other or moved apart. The pull tab is operable to control the pressure plate toward or away from the two second stop walls of the slider, enabling the slider to be locked to or unlocked from the first and second zipper tapes.

DETAILED DESCRIPTION OF THE PREFERRED EMBODIMENT

Figure 1:
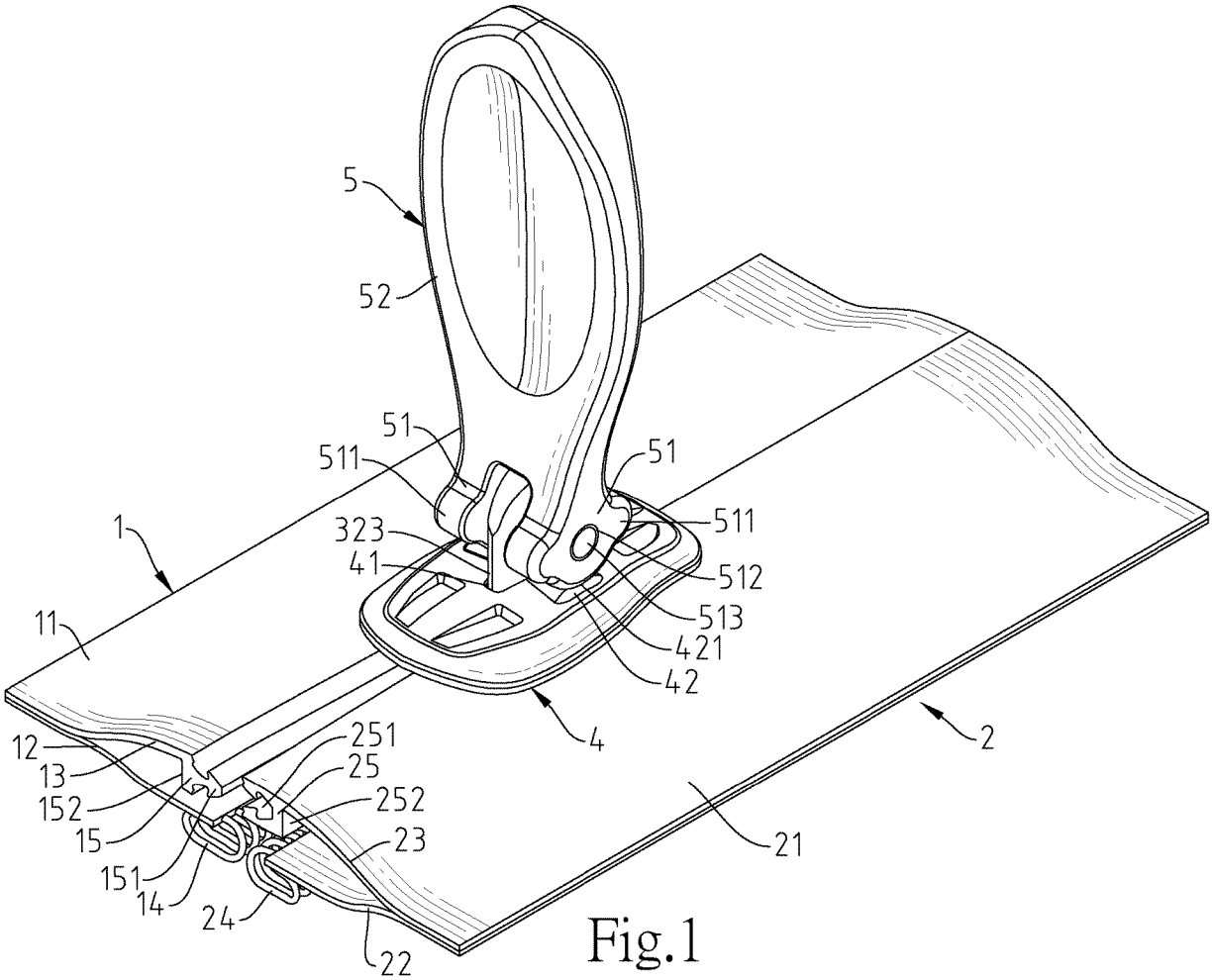
FIG. 1 is a perspective view of a waterproof zipper in accordance with an embodiment of the present invention.
Figure 2:
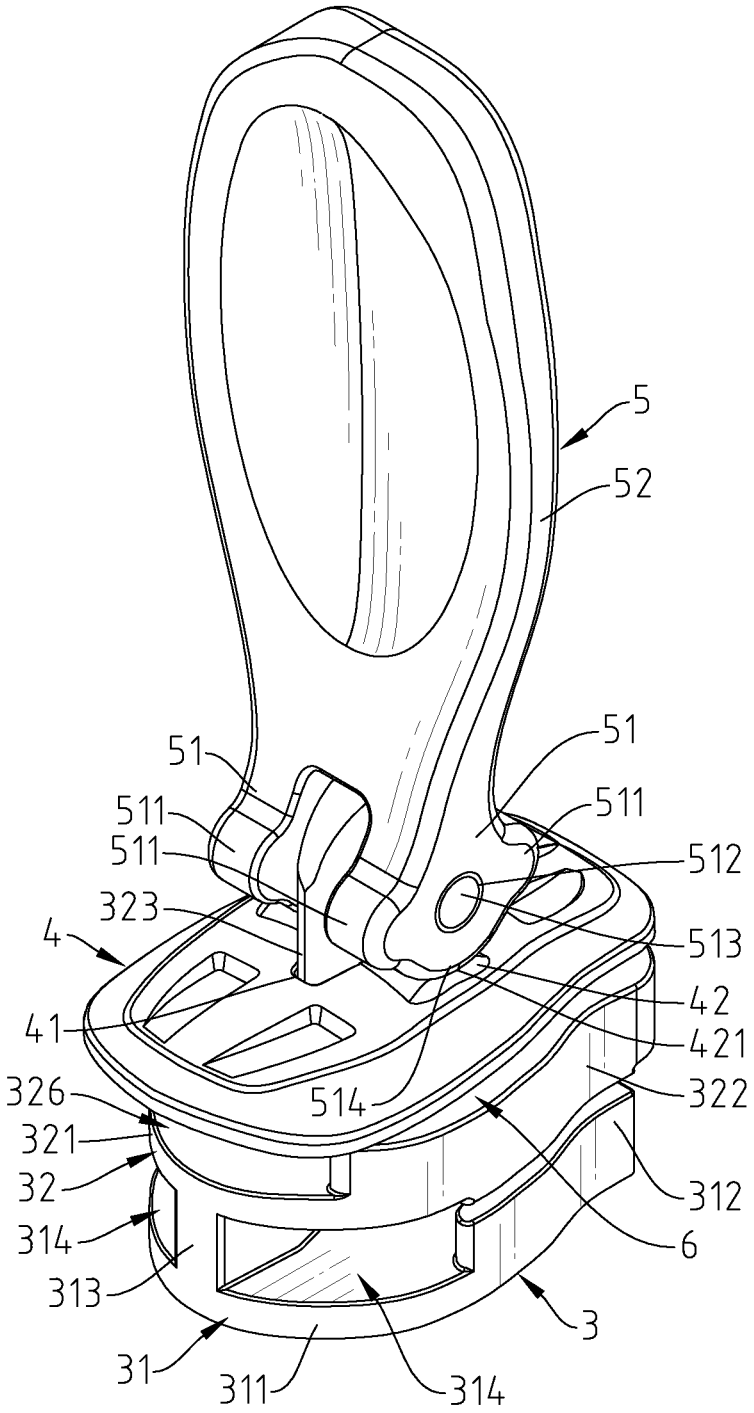
FIG. 2 is top a perspective view of the zipper slider of the waterproof zipper in accordance with an embodiment of the present invention.
Figure 3:
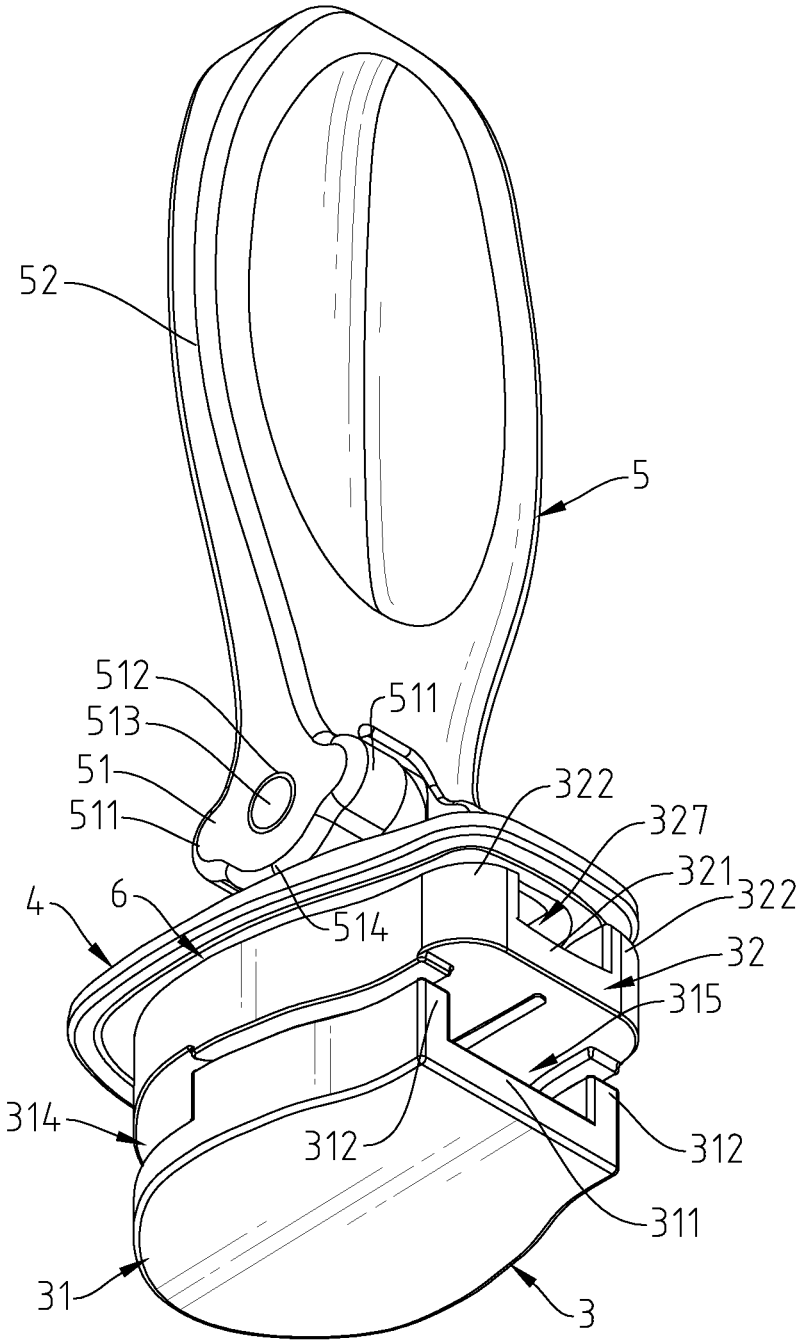
FIG. 3 is a bottom perspective view of the zipper slider of the waterproof zipper in accordance with an embodiment of the present invention.
Figure 4:
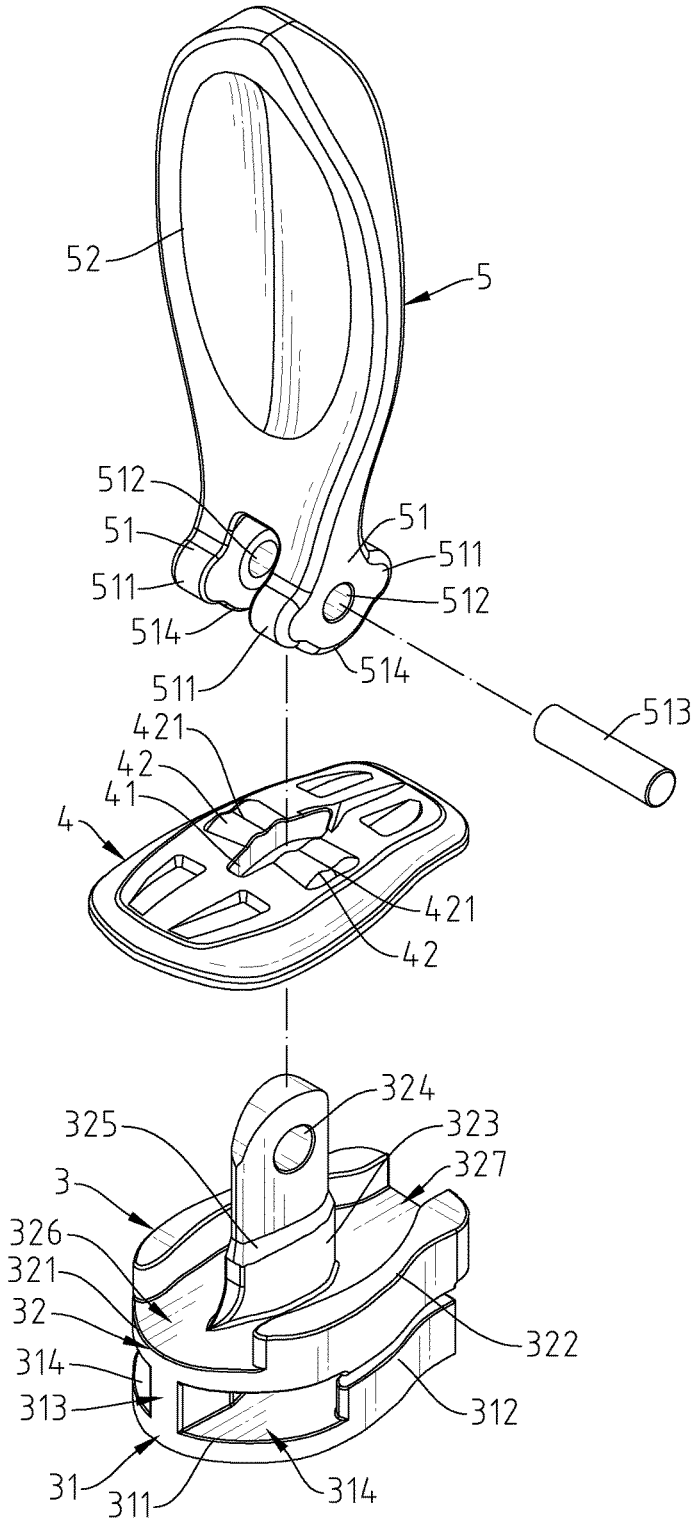
FIG. 4 is an exploded view of the zipper slider of the waterproof zipper in accordance with an embodiment of the present invention.
Figure 5:
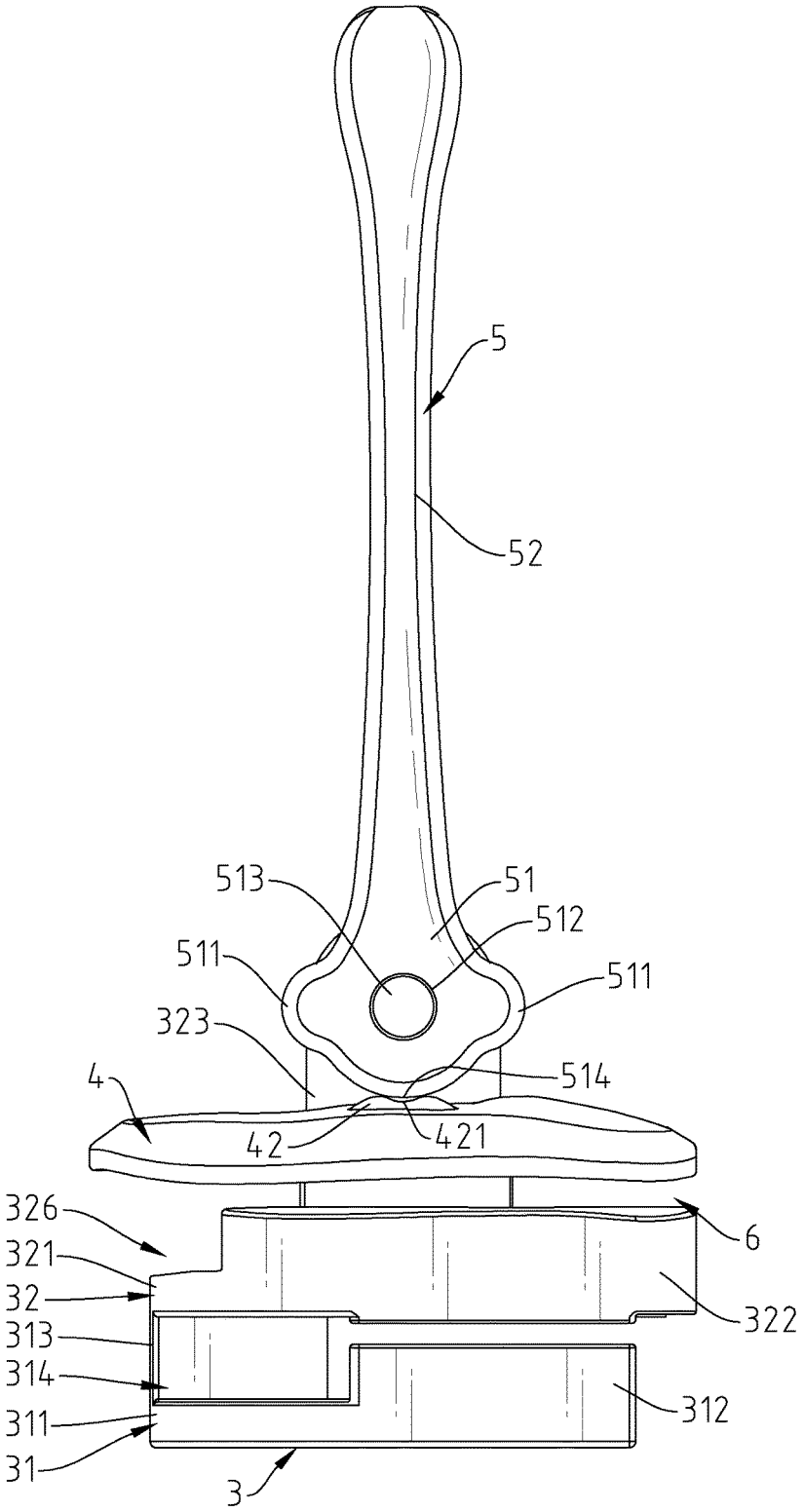
FIG. 5 is a side view of the zipper slider of the waterproof zipper in accordance with an embodiment of the present invention, illustrating an arc convex portion of each coupling block engaged in a respective concave surface portion.
Figure 6:
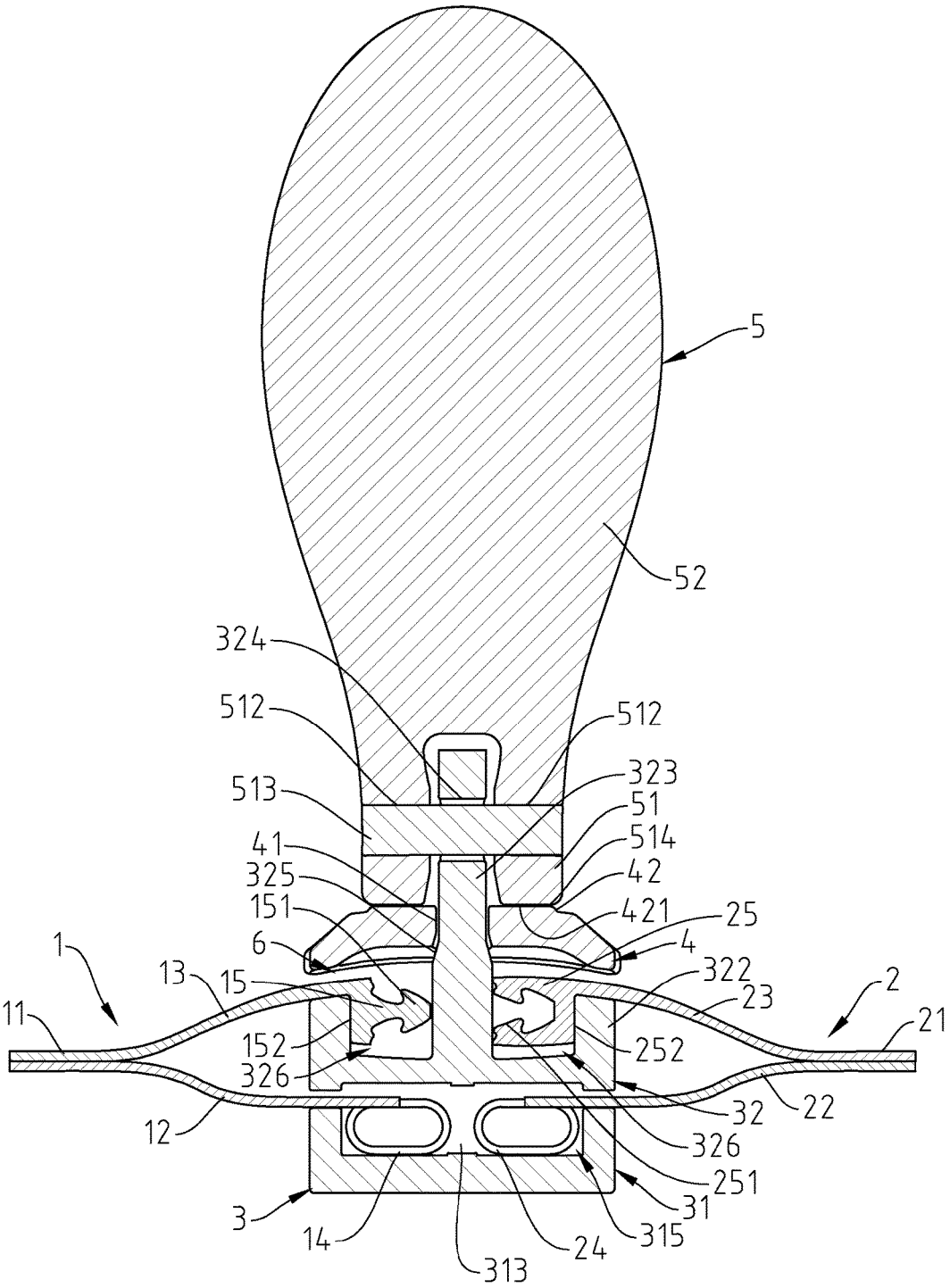
FIG. 6 is a schematic sectional applied view of an embodiment of the present invention.
Figure 7:
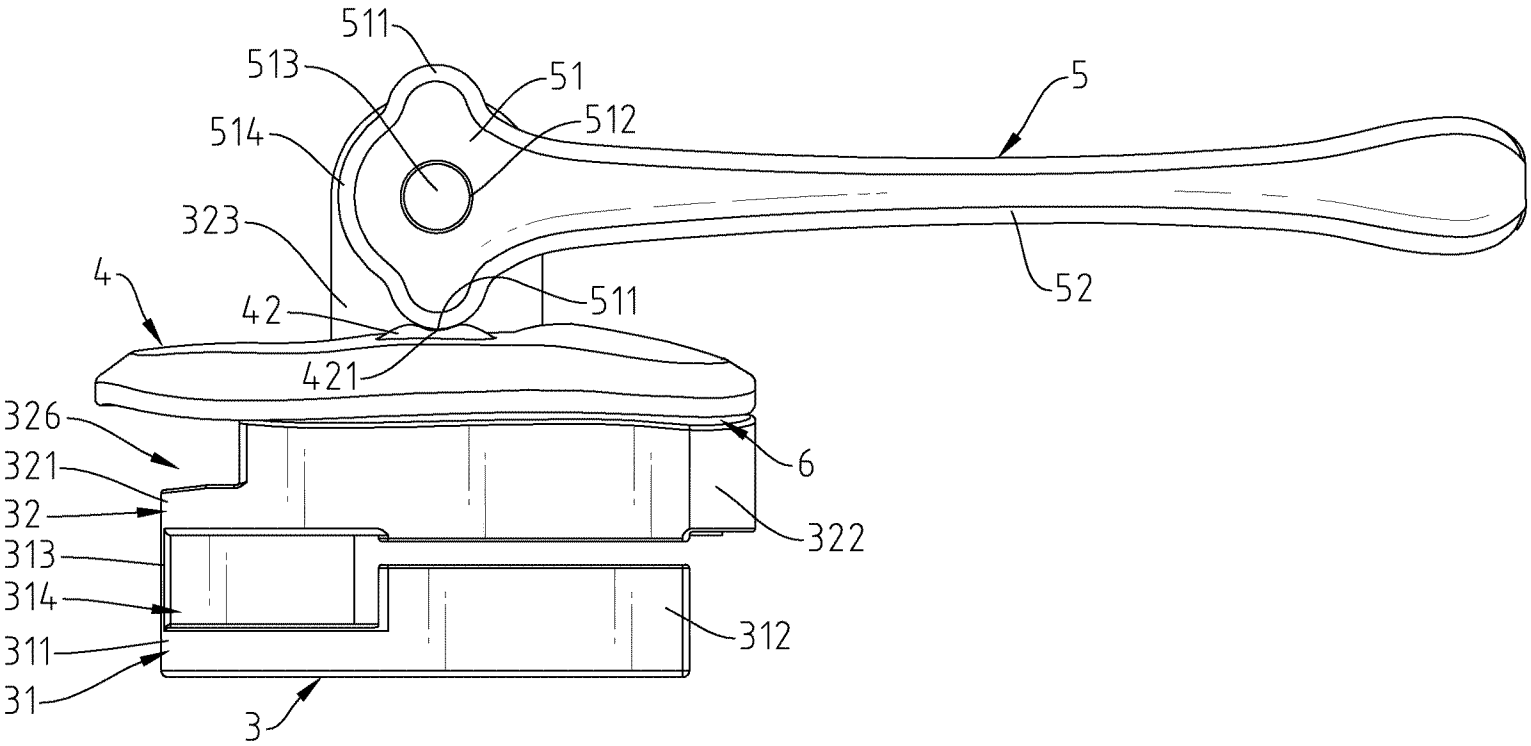
FIG. 7 is a side view of the zipper slider of the waterproof zipper in accordance with an embodiment of the present invention, illustrating one protruding rib of each coupling block engaged in a respective concave surface portion.
Figure 8:
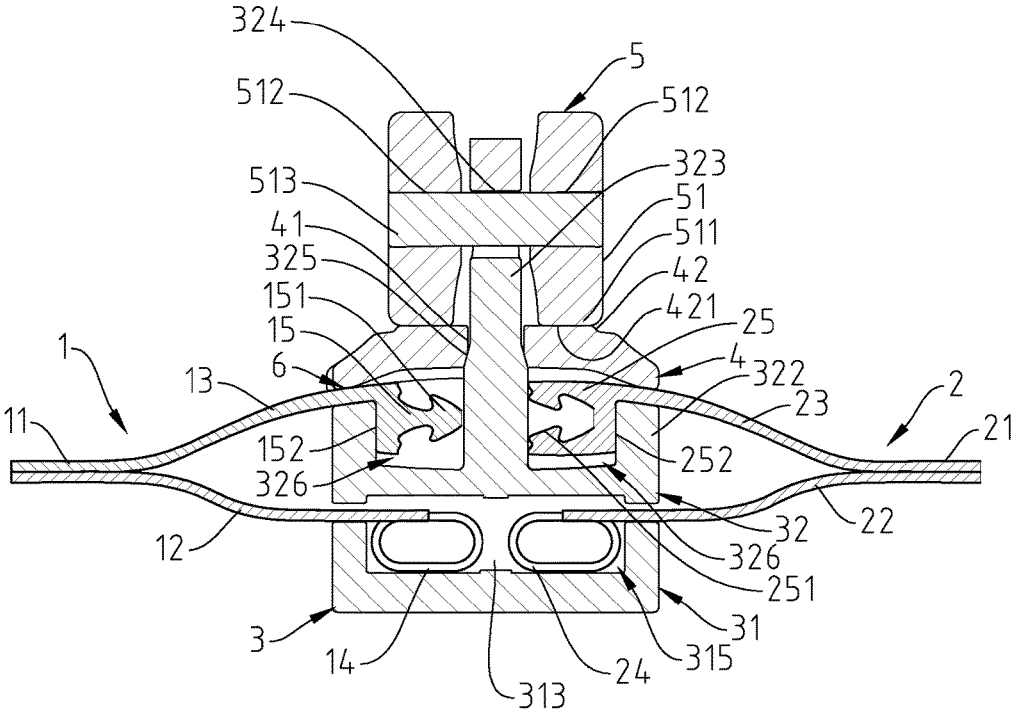
FIG. 8 is another schematic sectional applied view of an embodiment of the present invention.

Referring to FIGS. 1-8, a waterproof zipper in accordance with an embodiment of the present invention is shown. The waterproof zipper comprises a first zipper tape 1, a second zipper tape 2, and a zipper slider formed of a slider 3, a pressure plate 4 and a pull tab 5.

The first zipper tape 1 comprises a first base portion 11, a first rim strip portion 12 extended from one lateral side of the first base portion 11, a second rim strip portion 13 extended from the same lateral side of the first base portion 11 and suspending above the first rim strip portion 12, a first series of teeth 14 arranged along one lateral side of the first rim strip portion 12 remote from the first base portion 11, a lateral coupling strip portion 15 extended along one lateral side of the second rim strip portion 13 remote from the first base portion 11, a coupling flange 151 located at a bottom side of the lateral coupling strip portion 15 remote from the second rim strip portion 13 and extended along the length of the lateral coupling strip portion 15, and a first bearing edge 152 located at the bottom side of the lateral coupling strip portion 15 and abutted against the second rim strip portion 13.

The second zipper tape 2 comprises a second base portion 21, a third rim strip portion 22 extended from one lateral side of the second base portion 21, a fourth rim strip portion 23 extended from the same lateral side of the second base portion 21 and suspending above the third rim strip portion 22, a second series of teeth 24 arranged along one lateral side of the third rim strip portion 22 remote from the second base portion 21, a lateral retaining strip portion 25 extended along one lateral side of the fourth rim strip portion 23 remote from the second base portion 21, a retaining groove 251 located at a bottom side of the lateral retaining strip portion 25 remote from the fourth rim strip portion 23 and extended along the length of the lateral retaining strip portion 25, and a second bearing edge 252 located at the bottom side of the lateral retaining strip portion 25 and abutted against the fourth rim strip portion 23.

The slider 3 comprises a first slider frame 31 and a second slider frame 32. The first slider frame 31 comprises a first base wall 311, two first stop walls 312 respectively upwardly extended from two opposite lateral sides of the first base wall 311, a first spacer wall 313 upwardly extended from the first base wall 311 and equally spaced between the two first stop walls 312, two first diverging guide channels 314 defined between the first stop walls 312 and separated by the first spacer wall 313, and a first converging open chamber 315 defined between the first stop walls 312 at a rear side of the first spacer wall 313 and disposed in communication with the first diverging guide channels 314. The second slider frame 32 comprises a second base wall 321 integrally connected with the first spacer wall 313 and spaced above the first base wall 311, two second stop walls 322 respectively upwardly extended from two opposite lateral sides of the second base wall 321, a second spacer wall 323 upwardly extended from the second base wall 321 and equally spaced between the two second stop walls 322, two second diverging guide channels 326 defined between the second stop walls 322 and separated by the second spacer wall 323, a second converging open chamber 327 defined between the second stop walls 322 at a rear side of the second spacer wall 323 and disposed in communication with the second diverging guide channels 326, a pivot hole 324 transversely cu through the second spacer wall 323 near a top end thereof, and a bearing step 325 located on a middle part of the second spacer wall 323. When the waterproof zipper is assembled, the first series of teeth 14 and the first series of teeth 24 are respectively received in the two first diverging guide channels 314 and the first converging open chamber 315; the lateral coupling strip portion 15 and the lateral retaining strip portion 25 are respectively received in the two second diverging guide channels 326 and the second converging open chamber 327.

The pressure plate 4 is supported on the bearing step 325 of the second spacer wall 323, comprising a center slot 41 coupled to the second spacer wall 323, two locating blocks 42 raised from a top wall thereof and disposed at two opposite lateral sides relative to the center slot 41, and a concave surface portion 421 located on each locating block 42. Further, the pressure plate 4 has a bottom surface thereof inwardly curved, defining with the topmost edges of the two second stop walls 322 of the slider 3 a constraint space 6.

The pull tab 5 comprises a finger plate 52, two coupling blocks 51 extended from one end of the finger plate 52 in a parallel manner and pivoally coupled to the pivot hole 324 at the second spacer wall 323 of the slider 3 by a pivot pin 513. Each coupling block 51 comprises a pivot hole 512 coupled to the pivot pin 513, two protruding ribs 511 symmetrically located at two opposite lateral sides thereof, and an arc convex portion 514 located at a bottom side thereof and equally spaced from the two protruding ribs 511. The distance between the outer peripheral edge of each protruding rib 511 and the center of the pivot hole 512 is larger than the distance between the outer peripheral edge of the arc convex portion 514 and the center of the pivot hole 512.

Referring to FIGS. 1-3 again, in application, the first zipper tape 1 and the second zipper tape 2 are bonded or stitched to a hand bag, bag, raincoat, travel bag, etc., keeping the first series of teeth 14 and the second series of teeth 24 as well as the lateral coupling strip portion 15 and the lateral retaining strip portion 25 at two opposite lateral sides relative to the first spacer wall 313 and the second spacer wall 323. At this time, the user can pull the pull tab 5 to move the slider 3 between the first rim strip portion 12 and the third rim strip portion 22 and also between the second rim strip portion 13 and the fourth rim strip portion 23 from one end toward the other end, forcing the first series of teeth 14 and the first series of teeth 24 toward each other. By means of the guiding of the first stop walls 312, the first series of teeth 14 and the first series of teeth 24 are forced into engagement with each other in the first converging open chamber 315, and therefore, the first series of teeth 14 and the first series of teeth 24 are interlocked and will not be disengaged from each other even if the first zipper tape 1 and the second zipper tape 2 are stretched by an external force, providing enhanced tensile strength. During sliding movement of the zipper slider, the lateral coupling strip portion 15 and the lateral retaining strip portion 25 are moved toward each other. At this time, the first bearing edge 152 of the lateral coupling strip portion 15 and the second bearing edge 252 of the lateral retaining strip portion 25 are guided by the second stop walls 322, causing the lateral coupling strip portion 15 and the lateral retaining strip portion 25 to abut against each other in the second converging open chamber 327 and forcing the coupling flange 151 into engagement with the retaining groove 251 to prohibit passing of any external wind or fluid from one side of the waterproof zipper to the other side of the waterproof zipper. Thus, the invention achieves excellent windproof and waterproof effects, i.e., the waterproof zipper of the invention is practical for use in any article that needs to protect against wind and water (such as: raincoat). When wishing to separate the first zipper tape 1 and the second zipper tape 2, pull the pull tab 5 in the reversed directions to move the first spacer wall 313 between the first series of teeth 14 and the first series of teeth 24. Subject to the guiding of the first stop walls 312, the first series of teeth 14 and the first series of teeth 24 are respectively abutted against the two opposite lateral sides of the first spacer wall 313 and the second spacer wall 323 is put in between the lateral coupling strip portion 15 and the lateral retaining strip portion 25. Further, subject to the guiding of the second stop walls 322, the lateral coupling strip portion 15 and the lateral retaining strip portion 25 are respectively abutted against the two opposite lateral sides of the second spacer wall 323, causing disengagement of the coupling flange 151 from the retaining groove 251, and thus, the slider 3 is returned to its former position.

Referring to FIGS. 1 and 5-8 again, as illustrated, when positioning the slider 3, operate the finger plate 52 of the pull tab 5 to force one protruding rib 511 of each coupling block 51 into engagement with one respective concave surface portion 421 of the pressure plate 4 to further move the pressure plate 4 toward the second slider frame 32, enabling the second rim strip portion 13 of the first zipper tape 1 and the fourth rim strip portion 23 of the second zipper tape 2 to be squeezed by the bottom edge of the pressure plate 4 and the topmost edges of the second stop walls 322 and firmly secured in the constraint space 6, and thus, the slider 3 is locked to the first zipper tape 1 and the second zipper tape 2. When wishing to unlock the slide 3 from the first zipper tape 1 and the second zipper tape 2, operate the finger plate 52 of the pull tab 5 to shift the arc convex portion 514 of each coupling block 51 into the respective concave surface portion 421 of the pressure plate 4, at this time, the pressure plate 4 is released from the pressure of the coupling blocks 51, allowing the second rim strip portion 13 of the first zipper tape 1 and the fourth rim strip portion 23 of the second zipper tape 2 to be moved in the constraint space 6, and thus, the slider 3 is unlocked from the first zipper tape 1 and the second zipper tape 2 for free movement.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A waterproof zipper, comprising:

a first zipper tape comprising a first base portion, a first rim strip portion extended from one lateral side of said first base portion, a second rim strip portion extended from the same lateral side of said first base portion and suspending above said first rim strip portion, a first series of teeth arranged along one lateral side of said first rim strip portion remote from said first base portion, a lateral coupling strip portion extended along one lateral side of said second rim strip portion remote from the first base portion, and a coupling flange located at a bottom side of said lateral coupling strip portion remote from said second rim strip portion and extended along the length of said lateral coupling strip portion;

a second zipper tape comprising a second base portion, a third rim strip portion extended from one lateral side of said second base portion, a fourth rim strip portion extended from the same lateral side of said second base portion and suspending above said third rim strip portion, a second series of teeth arranged along one lateral side of said third rim strip portion remote from said second base portion for interlocking with said first series of teeth, a lateral retaining strip portion extended along one lateral side of said fourth rim strip portion remote from said second base portion, and a retaining groove located at a bottom side of said lateral retaining strip portion remote from said fourth rim strip portion and extended along the length of said lateral retaining strip portion for engagement with said coupling flange;

a slider comprising a first slider frame and a second slider frame, said first slider frame comprising a first base wall, two first stop walls respectively upwardly extended from two opposite lateral sides of said first base wall, a first spacer wall upwardly extended from said first base wall and equally spaced between said two first stop walls, two first diverging guide channels defined between said first stop walls and separated by said first spacer wall for receiving said first series of teeth and said second series of teeth respectively, and a first converging open chamber defined between said first stop walls at a rear side of said first spacer wall and disposed in communication with said first diverging guide channels for forcing said first series of teeth and said second series of teeth into engagement with each other, said second slider frame comprising a second base wall integrally connected with said first spacer wall and spaced above said first base wall, two second stop walls respectively upwardly extended from two opposite lateral sides of said second base wall, a second spacer wall upwardly extended from said second base wall and equally spaced between said two second stop walls, two second diverging guide channels defined between said second stop walls and separated by said second spacer wall for receiving said lateral coupling strip portion and said lateral retaining strip portion, a second converging open chamber defined between said second stop walls at a rear side of said second spacer wall and disposed in communication with said second diverging guide channels for keeping said lateral coupling strip portion and said lateral retaining strip portion in abutment against each other, a pivot hole transversely through said second spacer wall near a top end thereof, and a bearing step located on a middle part of said second spacer wall;

a pressure plate supported on said bearing step of said second spacer wall and defining with the topmost edges of said second stop walls of said slider a constraint space, said pressure plate comprising a center slot coupled to said second spacer wall, two locating blocks raised from a top wall thereof and disposed at two opposite lateral sides relative to said center slot and a concave surface portion located on each said locating block; and a pull tab comprising a finger plate, two coupling blocks extended from one end of said finger plate in a parallel manner and a pivot pin pivotally coupling said coupling blocks to said pivot hole of said slider, each said coupling block comprising a pivot hole aligned with the pivot hole at said second spacer wall of said slider for receiving the pivot pin, two protruding ribs symmetrically located at two opposite lateral sides thereof and an arc convex portion located at a bottom side thereof and equally spaced from said two protruding ribs for positioning in said concave surface portion at one said locating block of said pressure plate to force said pressure plate downwardly forward said slider.

2. The waterproof zipper as claimed in claim 1, wherein said first zipper tape further comprises a first bearing edge located at the bottom side of said lateral coupling strip portion and abutted against said second rim strip portion; said second zipper tape further comprises a second bearing edge located at the bottom side of said lateral retaining strip portion and abutted against said fourth rim strip portion.

3. The waterproof zipper as claimed in claim 1, wherein the distance between the outer peripheral edge of each said protruding rib and the center of the pivot hole of the respective said coupling block of said pull tab is larger than the distance between the outer peripheral edge of said arc convex portion and the center of the pivot hole of the respective said coupling block of said pull tab.

* * * * *